US005172749A

United States Patent [19]

Flemming

[11] Patent Number: 5,172,749

[45] Date of Patent: Dec. 22, 1992

[54] CONTINUOUS STEEL CASTING MOLD

[75] Inventor: Günter Flemming, Erkrath, Fed. Rep. of Germany

[73] Assignee: SMS Schloemann Siemag Aktiengesellschaft, Dusseldorf, Fed. Rep. of Germany

[21] Appl. No.: 812,440

[22] Filed: Dec. 23, 1991

[30] Foreign Application Priority Data

Dec. 24, 1990 [DE] Fed. Rep. of Germany ..... 4041830

[51] Int. Cl.[5] ..... B22D 11/00; B22C 3/00

[52] U.S. Cl. ..... 164/418; 164/459; 164/138

[58] Field of Search ..... 164/418, 138, 459

[56] References Cited

U.S. PATENT DOCUMENTS 4,023,612 5/1977 Jackson ..... 164/459
4,635,702 1/1987 Kolakowski et al. ..... 164/418

FOREIGN PATENT DOCUMENTS 56-68555 6/1981 Japan ..... 164/418
60-18252 1/1985 Japan ..... 164/418
2-220736 9/1990 Japan ..... 164/459

*Primary Examiner*—Richard K. Seidel
*Assistant Examiner*—Jeffrey T. Knapp
*Attorney, Agent, or Firm*—Anderson Kill Olick & Oshinsky

[57] ABSTRACT

A continuous steel casting mold includes walls with base members of copper alloy which are provided with cooling ducts. In order to improve the wear resistance and to prevent cracks, a working coating of pure copper is provided on the base members. It is also possible to provide an intermediate layer of pure copper on the base member and a working coating on the intermediate layer. The layer of pure copper has a thickness of at least 0.2 mm.

8 Claims, 1 Drawing Sheet

CONTINUOUS STEEL CASTING MOLD

BACKGROUND OF THE INVENTION

1. Field of the Invention

The present invention relates to a continuous steel casting mold whose walls are composed of a base member of copper alloy provided with cooling ducts and of a working coating provided on the base member.

2. Description of the Related Art

The most important requirements made of continuous steel casting molds are good heat conductivity, resistance to wear and dimensional stability. In order to meet these requirements, continuous steel casting molds have been developed which have shaping walls of pure copper, copper alloy and of copper coated with chromium and nickel.

EP-A-0 383 934 discloses continuous steel casting molds whose walls which consist of copper or copper alloy have on the working side a coating of nickel alloy. In order to flatten the differences in degrees of hardness between the copper wall and the very hard nickel alloy layer and for improving the connection, an intermediate layer of nickel is arranged between the copper wall and the layer of nickel alloy.

In continuous casting plants for casting steel strips developed more recently, the molds used in the plants are subjected to significantly more problems due to wear, stress-related distortion and the formation of cracks. This is because the casting rates are higher and the mold cavities have a complex shape.

The invention starts from the finding that local high stress peaks at the surface lead to damage, particularly to the formation of cracks, because of the fact that expansion is prevented. The tendency to form cracks and the spreading of cracks is increased by the formation of brass which is due to diffusion of zinc into the working surface.

SUMMARY OF THE INVENTION

Therefore, it is the object of the present invention to provide a continuous steel casting mold with broad side walls which form an upper widened portion, wherein the mold walls have even under increased loads an improved resistance to wear and an increased service life and particularly an excellent resistance to cracks and dimensional stability.

In accordance with the present invention, in a mold for continuously casting thin slabs, whose broad side walls form a widened pouring zone, the base members are provided with a layer of pure copper having a thickness of at least 0.2 mm.

Because of the high heat conductivity, the intermediate layer of pure copper according to the present invention results in a quick heat removal and, thus, in a reduction of the surface temperature. The toughness of the pure copper prevents or reduces the spreading of cracks, so that damage to the strain-hardened base member of copper alloy is prevented. This result cannot be obtained when using the known intermediate layers which are applied by nickel-plating and have a thickness of less than 10 μm.

The pure copper layer may form a working layer on the base member and may have a thickness of 1–8 mm. The toughness of this material prevents the formation of cracks and the spreading of cracks. The continuous wear prevents the formation of brass.

In accordance with a particularly advantageous feature of the invention, the pure copper layer forms a layer underneath a wear-resistant working coating, wherein the pure copper layer acts as a barrier and has a thickness of 0.2–0.4 mm.

The working coating applied on the intermediate layer may be of nickel, chromium, molybdenum or alloys thereof or of metal ceramics. The intermediate layer and the working layer may be applied in the known manner either electrolytically or by spraying.

The various features of novelty which characterize the invention are pointed out with particularity in the claims annexed to and forming a part of this disclosure For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
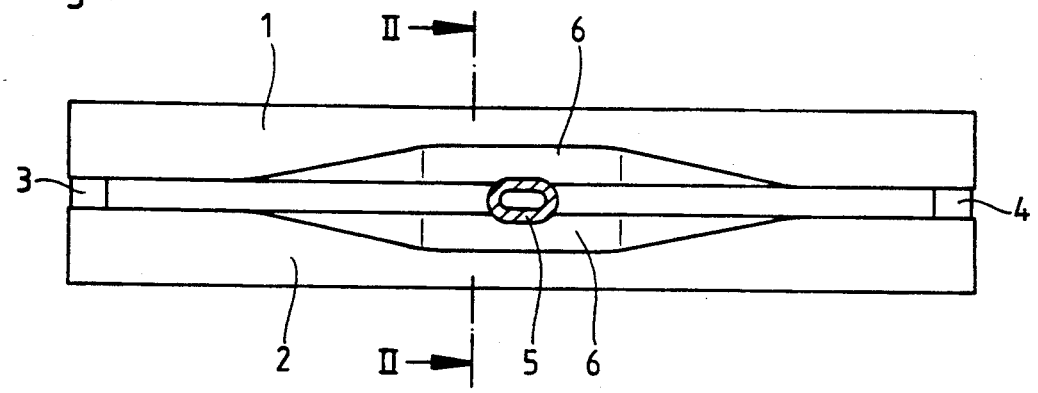
FIG. 1 is a schematic top view of a continuous steel casting mold with widened pouring zone.
Figure 2:
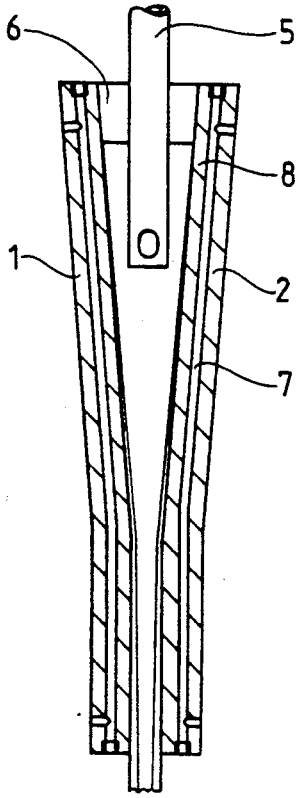
FIG. 2 is a vertical sectional view of the continuous steel casting mold taken along sectional line II—II of FIG. 1.

As illustrated in FIGS. 1 and 2, a continuous steel casting mold includes two broad side walls 1, 2 and two narrow side walls 3, 4 arranged between the broad side walls 1, 2. The broad side walls 1, 2 form a widened pouring zone 6 for receiving a pouring tube 5. The pouring zone 6 extends over a portion of the mold height. The mold wall includes a base member 8 which is provided with cooling ducts 7.

Figure 3:
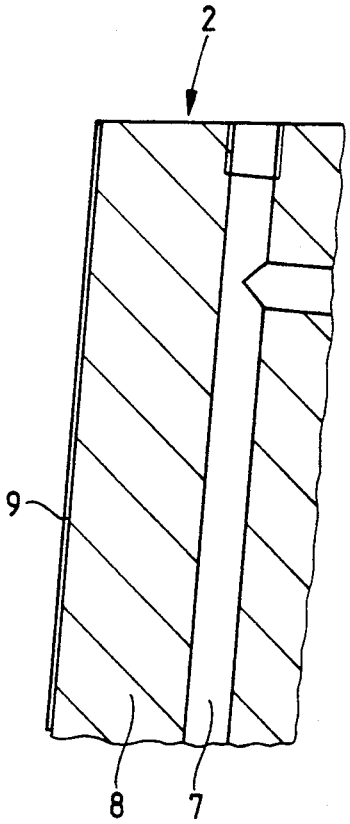
FIG. 3 is a partial sectional view, on a larger scale, of the upper side of the mold wall.

In the embodiment illustrated in FIG. 3, the base member 8 is provided with a working coating 9 of pure copper.

Figure 4:
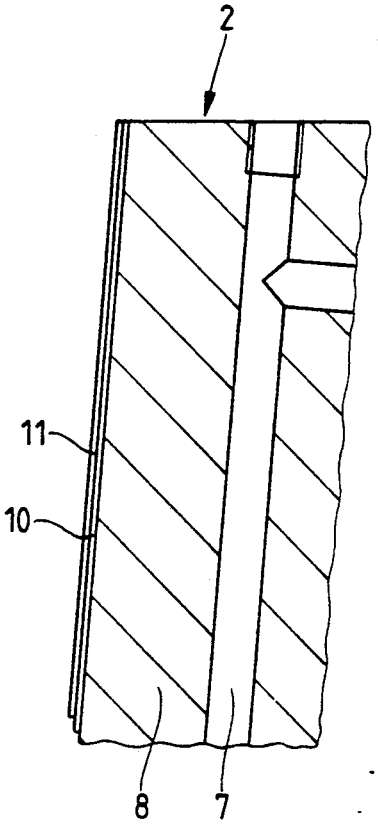
FIG. 4 is a view similar to FIG. 3, showing a different type of coating.

In the second embodiment shown in FIG. 4, the base member 8 is provided with an intermediate layer 10 of pure copper which is arranged underneath a working coating 11. In this case, the working coating 11 advantageously is of nickel or metal ceramics.

Both embodiments effectively prevent the formation of cracks and the increase of cracks in the base member 8.

While specific embodiments of the invention have been shown and described in detail to illustrate the inventive principles, it will be understood that the invention may be embodied otherwise without departing from such principles.

I claim:

1. A continuous steel casting mold for continuously casting thin slabs, the mold comprising broad side walls and narrow side walls between the broad side walls, the broad side walls defining a widened pouring zone, the broad side walls comprising a base member of copper alloy, the base member having cooling ducts, each broad side wall having a surface facing the pouring zone, the base member having on the surface thereof a working coating, the working coating being a layer of pure copper having a thickness of at least 0.2 mm.

2. The continuous steel casting mold according to claim 1, wherein the pure copper layer has a thickness of 1–8 mm.

3. A continuous steel casting mold for continuously casting thin slabs, the mold comprising broad side walls and narrow side walls between the broad side walls, the broad side walls defining a widened pouring zone, the broad side walls comprising a base member of copper alloy, the base member having cooling ducts, each broad side wall having a surface facing the pouring zone, the base member having on the surface thereof an intermediate layer, the intermediate layer being a layer of pure copper having a thickness of at least 0.2 mm and a working coating being placed on the intermediate layer.

4. The continuous steel casting mold according to claim 3, wherein the intermediate layer has a thickness of 0.2–0.4 mm.

5. The continuous steel casting mold according to claim 3, wherein the working coating consists essentially of nickel.

6. The continuous steel casting mold according to claim 3, wherein the working coating consists essentially of chromium.

7. The continuous steel casting mold according to claim 3, wherein the working coating consists essentially of molybdenum.

8. The continuous steel casting mold according to claim 3, wherein the working coating consists essentially of metal ceramics.

* * * * *